US006702270B1

(12) United States Patent
Reschke

(10) Patent No.: US 6,702,270 B1
(45) Date of Patent: Mar. 9, 2004

(54) CARPENTER'S STUD PLACEMENT AND SUPPORT DEVICE

(76) Inventor: Kurt Reschke, 1226 3rd Ave., Long View, WA (US) 98632

( * ) Notice: Subject to any disclaimer, the term of this patent is extended or adjusted under 35 U.S.C. 154(b) by 0 days.

(21) Appl. No.: 10/419,566

(22) Filed: Apr. 21, 2003

(51) Int. Cl.[7] ..... B25B 1/20

(52) U.S. Cl. ..... 269/41; 269/43; 269/910; 33/180 R; 30/358

(58) Field of Search ..... 33/180 R, 562, 33/189; 30/358; 269/41, 43, 910; 29/281.1, 281.3; 100/913, 154, 155

(56) References Cited

U.S. PATENT DOCUMENTS

| | | | | | |
|---|---|---|---|---|---|
| 3,201,874 | A | | 8/1965 | Christy | |
| 3,963,230 | A | * | 6/1976 | Jankowski, Jr. | 269/41 |
| 4,340,100 | A | * | 7/1982 | Anderson, II | 269/41 |
| 4,527,337 | A | | 7/1985 | Dreiling | |
| 4,625,415 | A | * | 12/1986 | Diamontis | 33/613 |
| 5,031,886 | A | | 7/1991 | Sosebee | |
| 5,364,084 | A | * | 11/1994 | Karash | 269/41 |
| 5,370,377 | A | * | 12/1994 | Van Der Meer | 269/43 |
| 5,414,918 | A | * | 5/1995 | Pearson | 29/33 K |
| 5,611,189 | A | * | 3/1997 | Fleck | 52/702 |
| 5,746,421 | A | * | 5/1998 | Bowerman | 269/41 |
| 5,832,618 | A | | 11/1998 | Scarborough | |
| 5,884,904 | A | * | 3/1999 | Martini | 269/41 |
| 6,155,547 | A | * | 12/2000 | Gatanas | 269/6 |
| 6,381,908 | B1 | * | 5/2002 | Fisher | 52/127.2 |
| 6,443,441 | B1 | * | 9/2002 | Buitenhuis | 269/41 |
| 6,536,752 | B1 | * | 3/2003 | Gatanas | 269/6 |

* cited by examiner

*Primary Examiner*—Joseph J. Hail, III
*Assistant Examiner*—Daniel Shanley
(74) *Attorney, Agent, or Firm*—Stephen R. Chapman

(57) ABSTRACT

A device to assist carpenters in holding a stud in position to be nailed or otherwise fastened to a sill or plate. Sill guides allow the device to be positioned at a predetermined point on a sill. A single blow with a hammer drives pins in the bottom of the base region of the device into the plate to secure the device on the plate. Three sill guides define the area in which the stud is positioned and supported for nailing to the sill. A hammer blow on the flange rocks the device so that the pins are pulled free and the device removed when the stud has been secured.

7 Claims, 5 Drawing Sheets

CARPENTER'S STUD PLACEMENT AND SUPPORT DEVICE

FIELD OF THE INVENTION

This invention is directed to simple devices useful to carpenters and similar craftpersons involved in residential and similar construction activities including remodeling that involves wall modifications and replacements. More specifically, this invention is directed to a reusable, sturdy device capable of supporting a wall stud in position to be nailed or otherwise fastened to a sill or plate. Even more specifically, the invention is directed to a device adapted to use in cramped locations and for replacing or relocating individual studs in existing interior and exterior walls.

BACKGROUND OF THE INVENTION

In spite of advances in materials and technology, many aspects of residential construction still require building both exterior and interior walls at a building site. In addition, residential remodeling and renovation, activities of growing popularity with the lay public, frequently include moving, modifying, or adding walls to existing structures, all of which may involve placing studs in the wall structure. A common challenge is for an individual to hold a stud in the proper location, and without assistance to nail, or otherwise secure the stud in the desired position.

A variety of devices are available to assist in the construction of an entire wall, including the lay-out of an entire wall and proper positioning and orientation of studs along the wall sills or plates. U.S. Pat. No. 5,832,618 issued Nov. 10, 1998 to Scaraborough describes a combination level and "T" square device used to equally position and orient wall studs in an entire wall structure. The device of the '618 patent does not address supporting the studs during construction of the wall.

The emphasis on spacing wall studs is reflected in the U.S. Pat. No. 5,031,886 issued Jul. 16, 1991 to Sosesbee. The '886 patent describes a spacing jig designed to minimize routine measurements for placing studs and designed to hold a series of studs in position along the sills or plates such that they can be nailed in position to yield the completed wall frame section. The jig of the '886 patent is useful for building sections of walls but not adapted to replacement of single studs or modifications of standing walls.

Numerous other U.S. patents address measuring and positioning wall studs, but not supporting the studs for nailing to sills or plates. U.S. Pat. No. 4,527,337 issued Jul. 9, 1985 to Dreiling describes a framing and stud template useful in repeatedly laying a series of stud locations along stringers. U.S. Pat. No. 3,201,874 issued Aug. 24, 1965 to Christy describes a "self-positioning stud spacing gauge." The device of the '874 patent spaces a second stud a specified, constant distance from an adjacent stud and by means of mechanical, jaw-like devices holds the stud in constant position to the adjacent stud for nailing.

There remains room for improvement in devices designed to temporarily secure a stud on a sill or plate at a designated position such that a single worker can both position and secure (nail) the stud in proper position.

SUMMARY OF THE INVENTION

One purpose of this invention is a device that will support a stud on a sill or plate in a designated position such that without assistance an individual worker may nail or otherwise fix the stud in position.

An additional purpose of this invention is a device that is readily positioned to support a stud in position to be nailed or otherwise fixed to a stud or sill and that can easily be removed for reuse when the stud is secured in the desired position.

Still a further purpose of this invention is a device that can be used in cramped areas and can be used to support closely spaced studs for nailing in position.

An additional purpose of the invention is sets of devices that may be used on various sizes of framing including the most common U.S. framing, 2×4 and 2×6 inch (approximately 5.1×10.2, and 5.1×15.3 cm, respectively).

These and other purposes are achieved by a metal device with a base plate having pins positioned on its bottom surface so as to hold the device in position on a sill or plate and the base plate being effectively as wide as the sill on which the device is intended for use, with a first pair of sill guides, one member of the pair deposed on either side of the base plate and formed along the length of the base plate from its rear edge, extending a length beyond the front edge of the base plate and deflected vertically downward from the base plate and at a right angle to the base plate such that they laterally support the device when positioned on a sill or plate and a second set of flanges formed on the upper edge of that portion of each member of the first pair of flanges that extends beyond the front edge of the base plate and deflected vertically upward at right angles to the base plate, with a third flange formed at the front edge of the base plate and deflected upward from the base plate at right angles to the base, and a rear flange deflected upward from the horizontal aspect of the base plate at an angle.

DESCRIPTION OF THE PREFERRED EMBODIMENT

Figure 1:
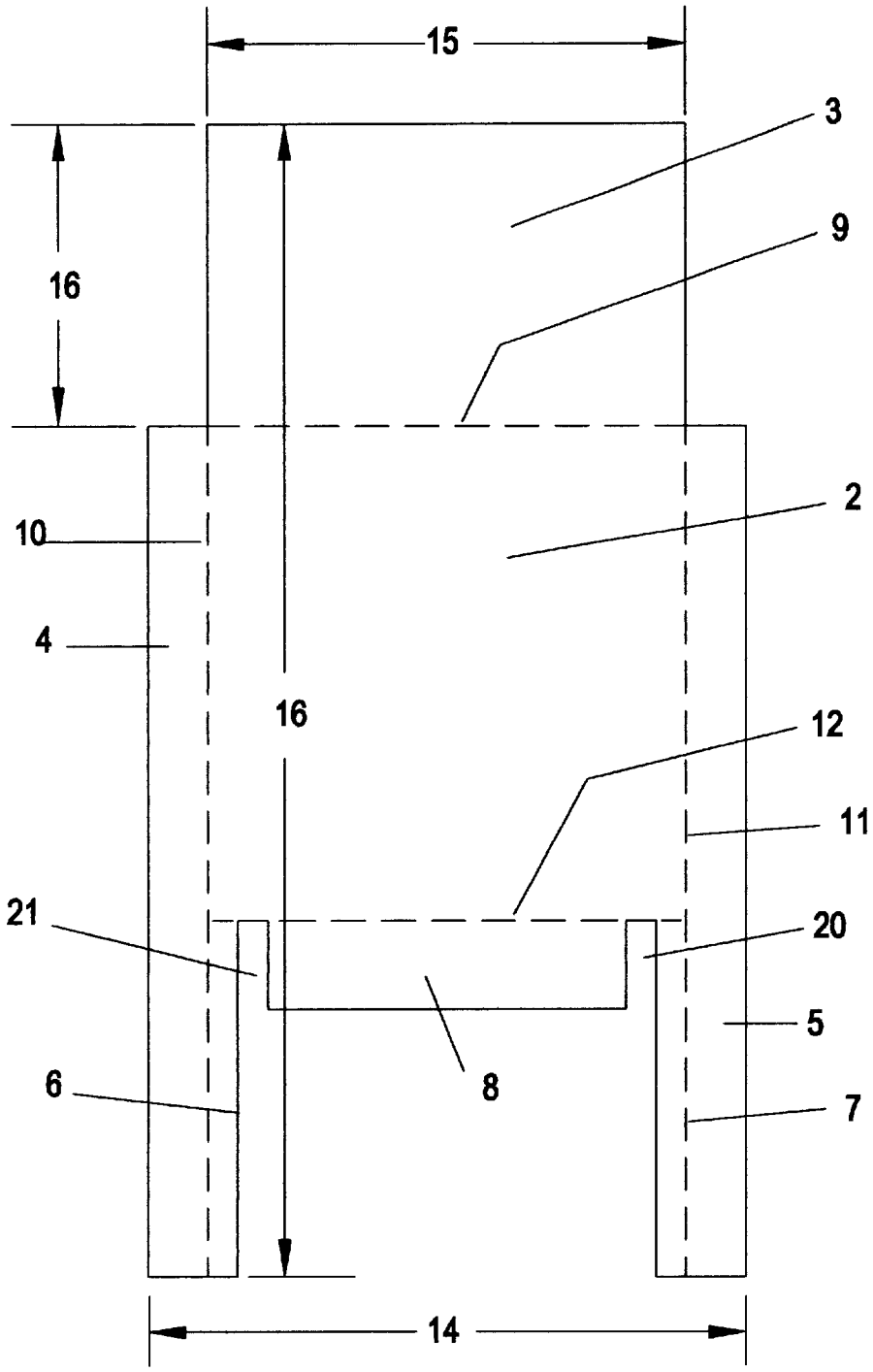
FIG. 1 illustrates a blank from which the finished device is fabricated.
Figure 3:
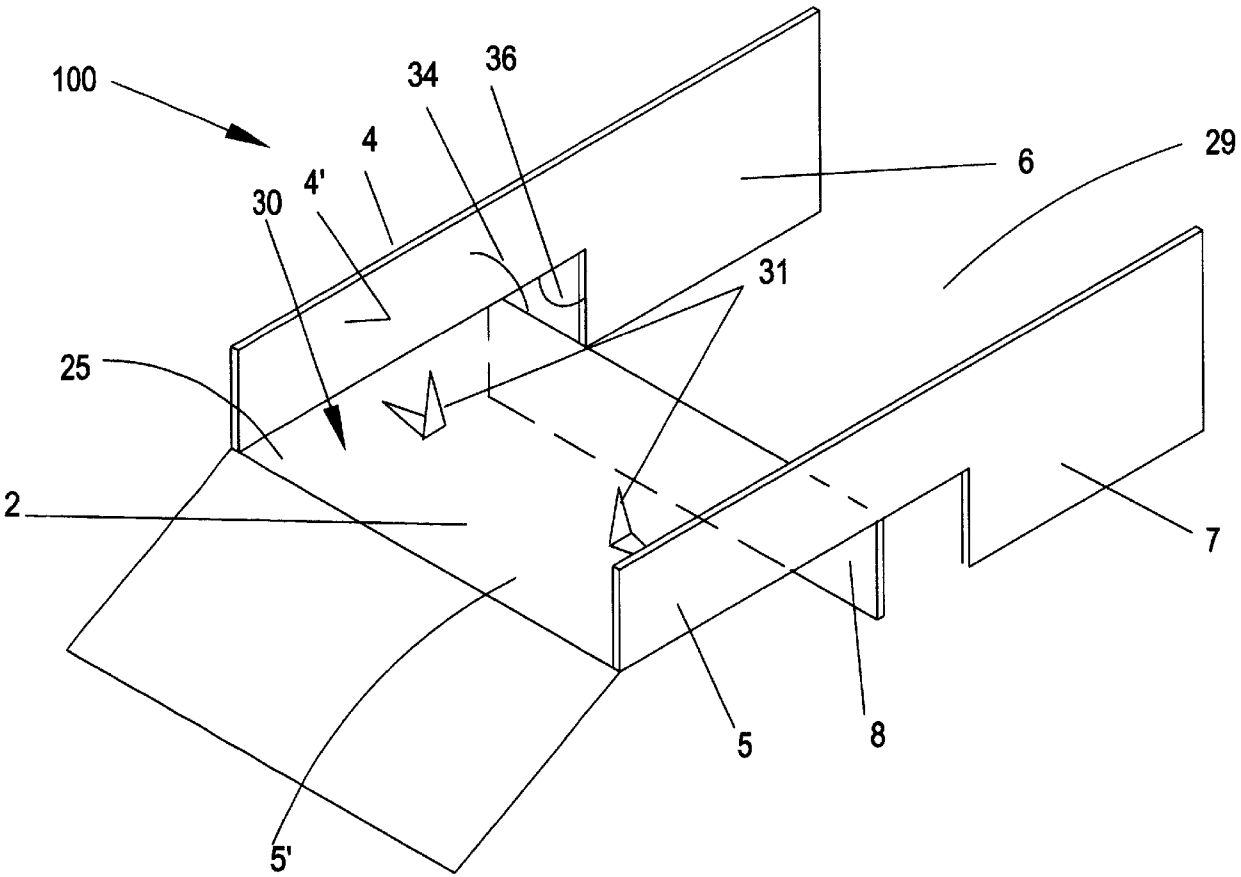
FIG. 3 is a schematic, three-dimension bottom view of the device.
Figure 4:
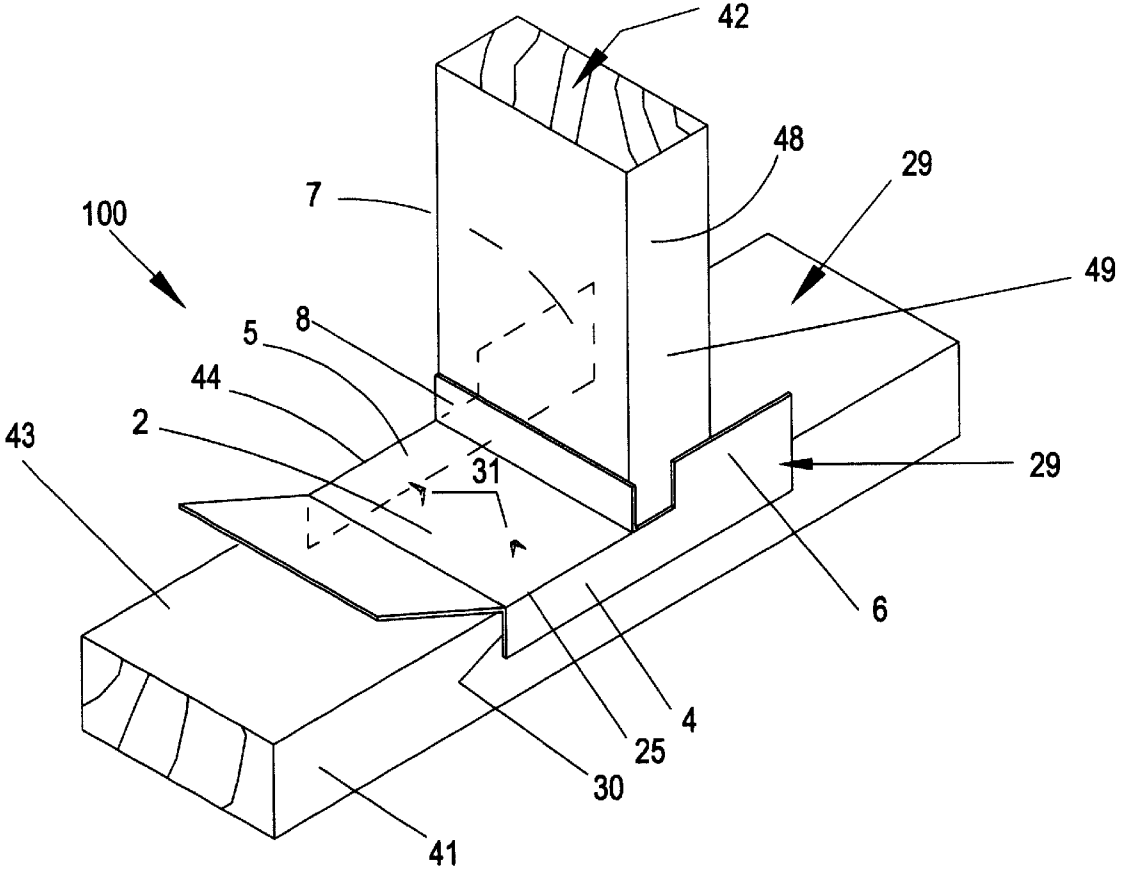
FIG. 4 illustrates the device positioned on a stud or plate with a stud positioned to be nailed to the sill or plate.

As illustrated in FIG. 1, the blank 1 of the device is cut from a sheet of steel, preferably A-36 mild steel, 10 gauge (U.S.S. Co., local suppliers) by means of a die or laser. The device 100 as illustrated in various views in FIGS. 2, 3, and 4 is formed in a two step die process that bonds the blank into its finished configuration.

The major, functional elements of the device are represented in the blank of FIG. 1. For convenience, the blank is described with the various elements arising from a base region 2. The overall length 13 is variable from 4 to 8 inches (10–20 cm), preferable approximately 6 inches (15 cm). The overall width 14 varies as a direct function of the dimensions of the stud to be supported and the sill or plate to which the stud is to be secured. The most common stud is a common 2×4 inch piece (10×20 cm) with a 2×4 sill or plate. By way of example, but not limitation, 2×6 inch (10×30 cm) sills are also used. With the 2×4 stud and sill, the overall width 14 is approximately 5 inches (approximately 13 cm) and with the 2×6 sill or plate the overall width 14 becomes 7 inches (approximately 18 cm). The corresponding width 15 of the base region 2 is 3½ inches (8.9 cm) for applications with a 2×4 sill or plate and 5½ inches (14 cm) for applications with a 2×6 sill. Note, the width 15 of the base region 2 is the same as the width of the flange 3. The length 16 of the flange 3 is 1⅝ inches (approximately 4 cm), and the height of the first 6, second 7, and third 8 stud guides is ⅜ inch (approximately 1 cm, each). The height of the first 4 and second 5 sill guide is ¾ inch (approximately 19 cm).

In addition to shaping the profile of the blank 1, two cuts 20 and 21 are made to allow shaping of the device from the blank. The first sill guide 4 is bent at right angles to the base region 2 downward along first line 10. This results in the first stud guide 6 being bent at right angle upward. Similarly the second sill guide 5 is bent downward along second line 11 and the second stud guide 7 is correspondingly bent upward. The third stud guide 8 is bent upward along third line 12 at right angle to the base region 2. The flange 3 is bent upward at an angle less than 90 degrees (preferably 30 to 45 degrees) along fourth line 9.

Figure 2:
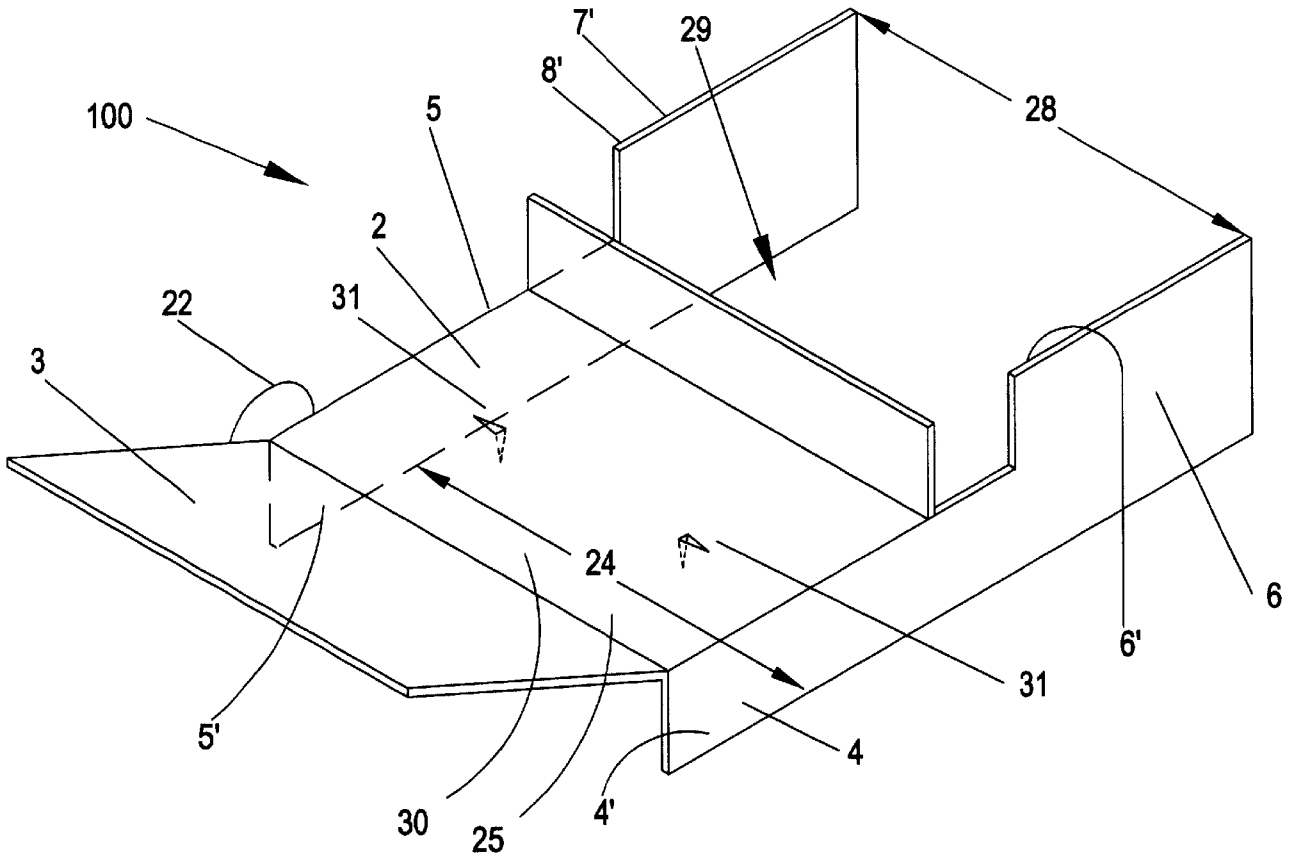
FIG. 2 is a schematic, three-dimensional, top view of the device.

The completed device 100 is illustrated in FIG. 2 from a top perspective. At least one, and preferably two pins 31 are formed on the bottom surface 25 of the base region 2. The positive angle of inflection 22 of the flange 3 from the base region 2 is indicated. The sill channel 30 is described and limited by the bottom surface of the base region 25 and the inner surfaces 4' and 5', respectively of the first sill guide 4 and the second sill guide 5. The sill channel 30 allows the device 100 to be positioned on a sill or plate. The sill guides 4 and 5 minimized lateral movement of the device 100 on the sill. The bottom surface 25 of the base region 2 contacts the upper surface of the sill or plate (FIG. 4) and the pins 31 prevent longitudinal movement of the device on the sill. The inside width 24 of the channel 30 is appropriate for the width of the sill or plate to which the stud is to be attached. For a standard 2×4, approximately 3½ inches and for a 2×6, approximately 5½ inches. The inner surface of the first stud guide 6' and second stud guide 7,' and the outer surface of the third stud guide 8' define the stud positioning support area 29 in which the stud to be secured to the sill is positioned when the device is attached to the sill or plate. With the device positioned on the sill or plate, the top of the sill or plate becomes the floor of the area 29. The width 28 of the area 29 is the same as the width of the stud to be positioned. The first stud guide 6 and second stud guide 7 prevent lateraL movement or twisting of the stud when is positioned in the device as illustrated in FIG. 4, and the longitudinal movement of the stud is limited by holding the stud firmly against the outer surface of the third stud guide 8'. The outer surface of the third stud guide 8' is aligned with the position on the sill or plate to locate the stud properly on the sill or plate as one skilled in the art understands.

FIG. 3 provides a view from the bottom side of the device 100 showing the details of the pins 31 located approximately 1 inch (2.5 cm) from the edge of the third stud guide 8 approximately one inch (2.5 cm) apart on the bottom surface 25 of the base region. Each pin is from about ⅛ to ¾ inch in length (0.32 to 1.9 cm). FIG. 3 also illustrates the 90 degree (right angle) downward orientation 34 of the first 4 and second 5 sill guide relative to the base region 2 and the corresponding 90 degree (right angle) upward orientation 36 of the first 6, second 7, and third 8 stud guides. The channel 30 is defined and limited by the bottom surface 25 of the base region 2 and by the inner surfaces of the first sill guide sill guide 4' and second sill guide 5. Similarly, the first stud guide 6, second stud guide 7, and third stud guide 8 define and limit the stud support area 29.

In FIG. 4, the device 100 is positioned on a sill 41. A section of the sill 41 is enclosed by the channel 30 the outside walls of which are the first 4 and second 5 sill guides. The bottom surface 25 of the base region 2 is in physical contact with the upper surface 43 of the sill. The pins 31 are seated in the sill as a result of a blow by a hammer on the upper surface 44 of the base region. A stud 42 is positioned in the stud positioning support area 29. Lateral movement of the stud 42 is limited by the first stud support 6 and the second stud support 7 and longitudinal movement is restricted by the third stud support 8. With the device in position, nails may be driven in the front face 48 of the stud 42, or in either side or both side faces 49.

Figure 5:
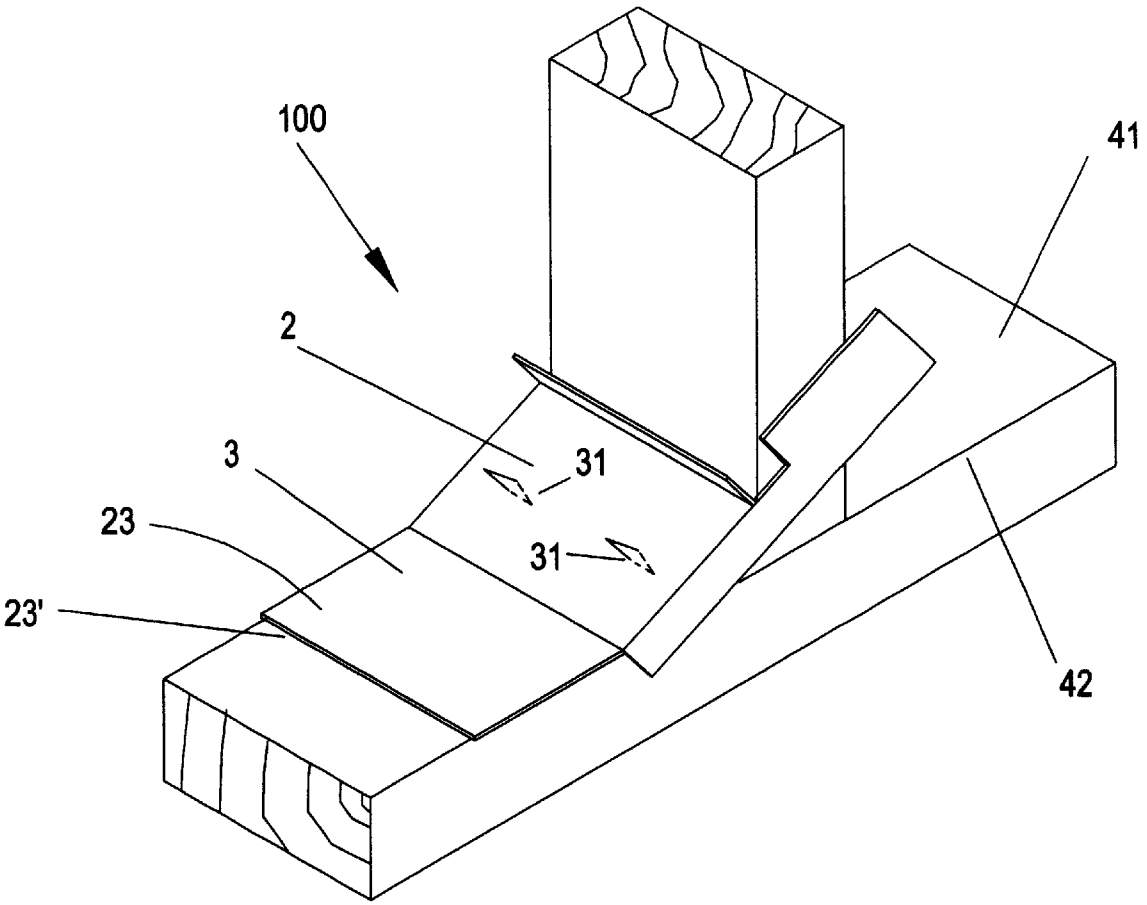
FIG. 5 illustrates the device ready to be removed from the sill or plate.

As illustrated in FIG. 5, the device 100 is freed from the sill after the stud is secured by striking the upper surface 23 of the flange 3 with a hammer. The flange is elevated at an angle from the horizontal line 42 of the sill 41 and base region 2 of the device 100 such that the blow rotates the bottom surface of the flange 23' downward to contact the sill 42. This rotation causes the base region to rotate upward, physically lifting the pins 31 from the sill.

Use of the device is simply illustrated by simultaneous reference to FIGS. 2 and 4. The device 100 is positioned on a sill or plate 41 such that the front face 8' of the third stud guide is aligned with a predetermined location of the stud 42 to be attached to the sill or plate. A blow with a hammer sets the pins 31 into the sill or plate 41 thus restricting movement of the device and holding the sill or plate in the channel 30 of the device 100. The sill guides 4 and 6 orient the sill or plate in the channel and serve to ensure that the face of the third stud guide 8 is at a 90 degree angle to the length of the sill or plate. These guides also minimize lateral movement of the guide as it is positioned on the sill or plate.

The stud 42 is positioned in the stud support area 29. The first 6, and second 7 stud guides orient the stud laterally on the sill or plate and hold it in position. The craftsman firmly holds the stud 42 against the outter surface 8' of the third stud guide thereby ensuring the stud is properly positioned. With the stud positioned as described, the pins 31 keep the device from moving when stud is attached to the sill or plate. The sill guides also help minimize lateral movement when the stud and sill or plate are joined. One skilled in the art understands that an individual craftsman can use the device without assistance. With one hand the stud is held to the third stud guide and a nail or comparable fastener positioned to secure stud to the sill or plate. The other, free hand is used to drive the nail or otherwise seat the fastener.

When the stud is adequately secured to the sill or plated, a single blow with a hammer or similar tool on the upper surface 23 of the flange 3 causes the device to rock as a result of the inflection of the flange relative to the base element 2 causing the base element to rotate upward thereby freeing the pins 31 from the sill or plate 41 and allowing the craftsman to simply remove the device from the sill or plate.

FIG. 1 illustrates the manufacture of the device from a single blank or work piece. The invention anticipates that any of the major parts, the pins, sill guides, or stud guides could be made from separate pieces and joined to the base region by welding or other comparable means without altering the scope or purpose of the invention. In such an example, lines indicating bending are welded joints connecting the elements to the base region. All dimensions and functions remain as previously discussed with respect to FIGS. 2, 3, 4, and 5.

What is claimed is:

1. A device capable of supporting a stud being attached to a sill-structure comprising:

a. a base region comprising an upper surface, a lower surface, a front end, a rear end, a first side, and a second side, wherein at least one pin is positioned on said lower surface of said base region;

b. a flange with an upper surface, and a lower surface, said flange being functionally, rigidly connected to the rear end of said base region, and said flange extending at a positive angle from the horizontal plane of said base region;

c. a first sill guide and a second sill guide each having an outer surface and an inner surface, said first sill guide being rigidly and functionally connected to and extending downward from said first edge, and said second sill guide being rigidly and functionally attached to and extending vertically downward from said second edge, and further wherein the space defined by said inner surface of said first sill guide and said inner surface of said second sill guide describes and defines the limit of a sill channel;

d. a first stud guide, a second stud guide, and a third stud guide each of which is rigidly attached to and extends vertically upward from said front end of said base region, and further wherein each of said first stud guide, said second stud guide, and said third stud guide has an outer surface and an inner surface, and further wherein said inner surface of said first stud guide and said inner surface of said second stud guide and said outer surface of said third stud guide define the perimeter of a stud positioning support area.

2. The device in claim 1 wherein the entire device is fabricated from a single work piece.

3. The device in claim 1 wherein the entire device is formed from at least two work pieces joined by welding means.

4. The device in claim 1 wherein the dimensions of said sill channel are adapted to 2×4 inch studs and sills.

5. The device in claim 1 wherein the dimensions of said sill channel are adapted to 2×6 inch studs and sills.

6. The device in claim 1 wherein the dimensions of said sill channel are adapted to studs and sills other than 2×4 inches and 2×6 inches.

7. A device capable of supporting a stud being attached to a sill-structure comprising:

a. a base region with an upper surface, a lower surface, a front end, a rear end, a first side, and a second side, wherein at least one pin capable of penetrating a sill on which said device is positioned and of securing said device to said sill is positioned on said lower surface of said base region;

b. a flange with an upper surface, a lower surface, said flange being rigidly and functionally connected to said rear end of said base region at a positive angle from the horizontal plane of said base region such that when said pin is secured in a sill, downward force on said upper surface of said flange will force said flange downward, thereby rocking said base region in an upward direction and causing said at least one pin to pull free of said sill.

c. a sill channel defined by a first sill guide and a second sill guide, said first sill guide being structurally connected to said first side of said base region and said second sill guide being structurally connected to said second side of said base region;

d. stud guides structurally attached to said front end of said base region so as to define the perimeter of a stud positioning area.

* * * * *